US005848822A

United States Patent [19]

Wu

[11] Patent Number: 5,848,822

[45] Date of Patent: Dec. 15, 1998

[54] FOLDING COLLAPSIBLE CHAIR

[76] Inventor: Tien Tzu Wu, No. 6, Alley 22, Shui Ching Hsiang, Shui Ching Li, Pei Tun Shu, Taichung, Taiwan

[21] Appl. No.: 831,424

[22] Filed: Apr. 1, 1997

[51] Int. Cl.[6] ..... A47C 9/00

[52] U.S. Cl. ..... 297/344.18; 297/183.1; 297/53; 108/119

[58] Field of Search ..... 297/183.1, 183.5, 297/183.9, 53, 344.18, 461; 108/116, 118, 119; 248/188.5, 432

[56] References Cited

U.S. PATENT DOCUMENTS

| | | | |
|---|---|---|---|
| 2,794,612 | 6/1957 | Clifton | 248/188.5 |
| 2,978,012 | 4/1961 | Norseen | 897/183.1 X |
| 3,033,511 | 5/1962 | McAfee | 248/432 X |
| 3,106,296 | 10/1963 | Walsh et al. | 108/119 X |
| 5,353,715 | 10/1994 | Luyk | 108/119 X |
| 5,522,642 | 6/1996 | Herzog | 297/344.18 |
| 5,536,068 | 7/1996 | Valentor et al. | 297/344.18 |
| 5,542,359 | 8/1996 | Polries | 108/119 X |

*Primary Examiner*—Peter R. Brown
*Attorney, Agent, or Firm*—Bacon & Thomas, PLLC

[57] ABSTRACT

A folding collapsible chair including a seat plate having a first longitudinal coupling groove and a second longitudinal coupling groove bilaterally disposed at a bottom side thereof, a plurality of vertical through holes, and two hand holes transversely disposed near two opposite ends; a folding stand adapted for supporting the seat plate, the folding stand including a first U-tube and a second U-tube pivoted together, and four retracting legs respectively mounted in two opposite ends of each of the first U-tube and the second U-tube, the first U-tube having a middle section peripherally forced into engagement with the first longitudinal coupling groove of the seat plate and turned therein, the second U-tube having a middle section adapted to be peripherally forced into engagement with the second longitudinal coupling groove of the seat plate; and a locating plate fixedly mounted on the bottom side of the seat plate over the middle section of the first U-tube to secure the seat plate and the first U-tube together.

3 Claims, 4 Drawing Sheets

FOLDING COLLAPSIBLE CHAIR

BACKGROUND OF THE INVENTION

The present invention relates to a folding collapsible chair, and more particularly to a folding collapsible chair adapted for use in a bathroom.

When washing the body, a chair may be used. FIG. 1 shows a chair for use in bathroom. This structure of chair comprises a seat plate A equipped with four legs B. The seat plate A is a flat plate having a plurality of through holes Al for drainage of water. This structure of chair has numerous drawbacks as outlined hereinafter.

1. Because the legs are fixedly fastened to the seat plate, the chair cannot be collapsed when not in use.

2. Because the top side of the seat plate is a flat surface, the chair is not comfortable to sit and water cannot be quickly carried away from the seat plate.

3. Because the seat plate has no means for the holding of the hand, the user may slip from the seat plate when sitting on it or standing up from it.

4. Because the legs are not retractable, the elevation of the chair cannot be adjusted to meet the user's satisfaction.

SUMMARY OF THE INVENTION

According to one aspect of the present invention, the folding collapsible chair is comprised of a seat plate having two longitudinal coupling grooves at the bottom, and a folding stand adapted for supporting the seat plate, the folding stand comprised of a first U-tube and a second U-tube pivoted together, and four legs respectively mounted in two opposite ends of each of the U-tubes, the first U-tube of the folding stand being secured to one longitudinal coupling groove of the seat plate by a locating plate and allowed to be turned therein, the second U-tube being adapted to be peripherally and detachably forced into engagement with the second longitudinal coupling groove of the seat plate. According to another aspect of the present invention, the seat plate has a downward stop block raised from the bottom along one side and adapted for stopping the second U-tube at the second longitudinal coupling groove. According to another aspect of the present invention, the seat plate has a concave top for comfortable sitting, and vertical through holes for guiding water out of the concave top. According to still another aspect of the present invention, the seat plate has two hand holes transversely disposed near two opposite ends for the holding of the hand. According to still another aspect of the present invention, the legs of the folding collapsible stand are retractable, so that the elevation of the folding collapsible chair can be adjusted.

DETAILED DESCRIPTION OF THE PREFERRED EMBODIMENT

Figure 1:
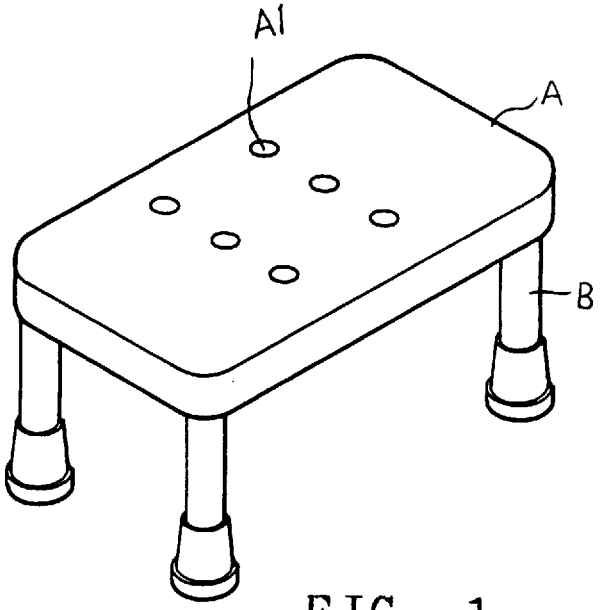
FIG. 1 is a chair for use in bathroom according to the prior art.
Figure 3:
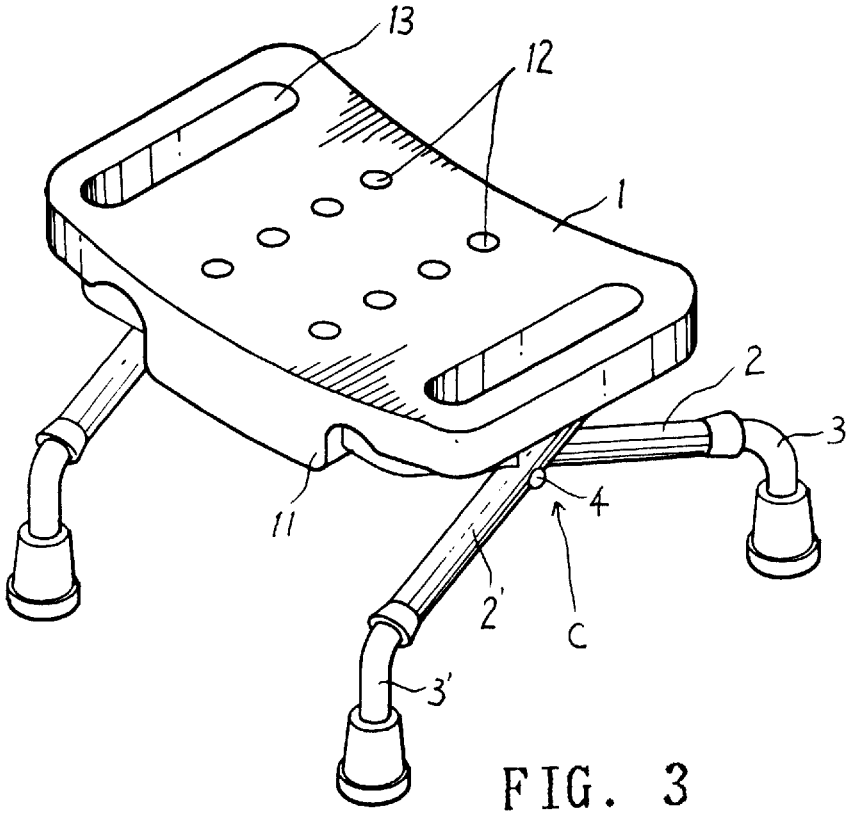
FIG. 3 is an exploded view of the folding collapsible chair shown in FIG. 2.
Figure 2:
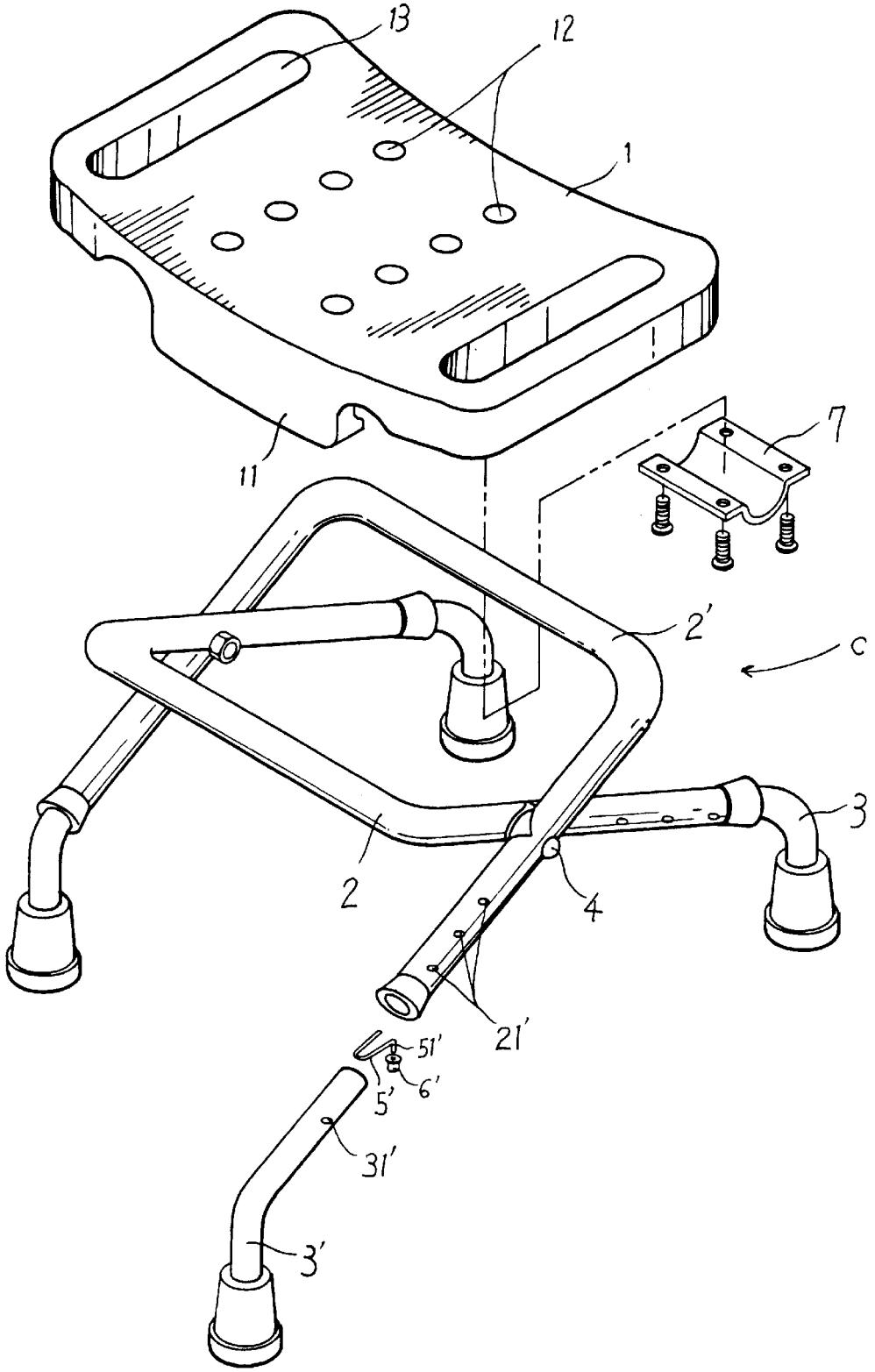
FIG. 2 is a folding collapsible chair for use in bathroom according to the present invention.
Figure 4:
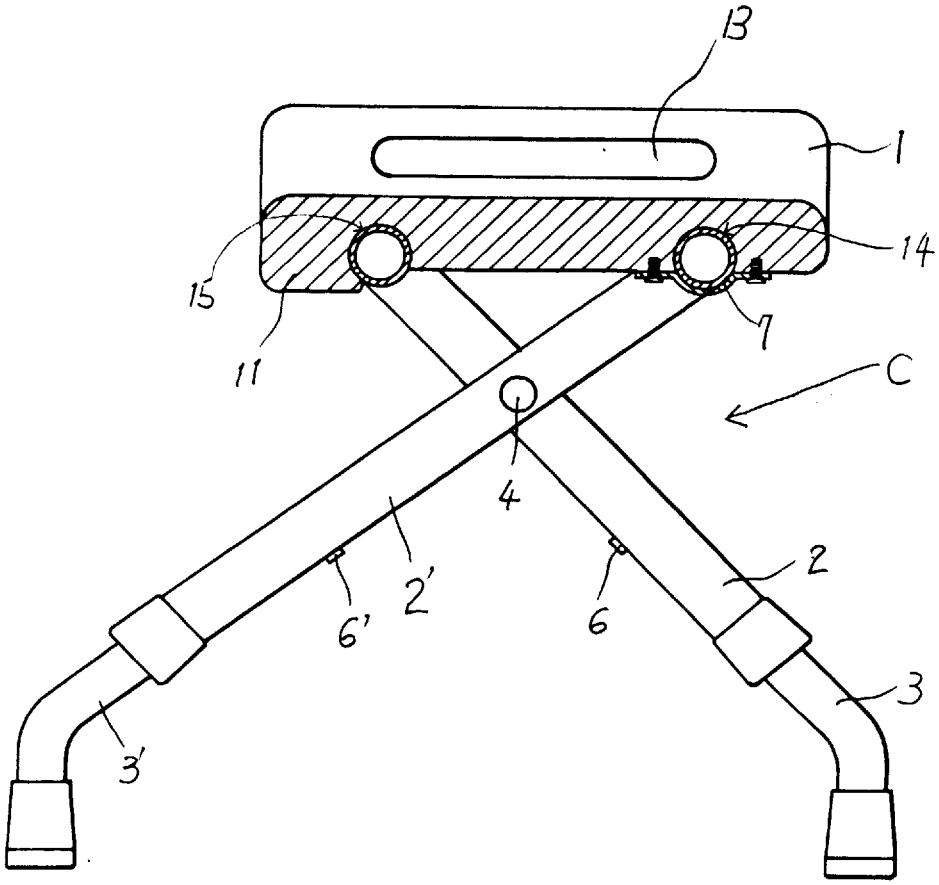
FIG. 4 is a sectional view of the present invention, showing the folding collapsible chair set in the operative condition.
Figures 1, 5:
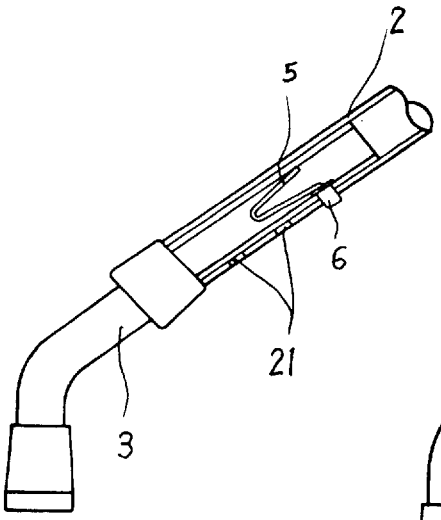
Figure 5:
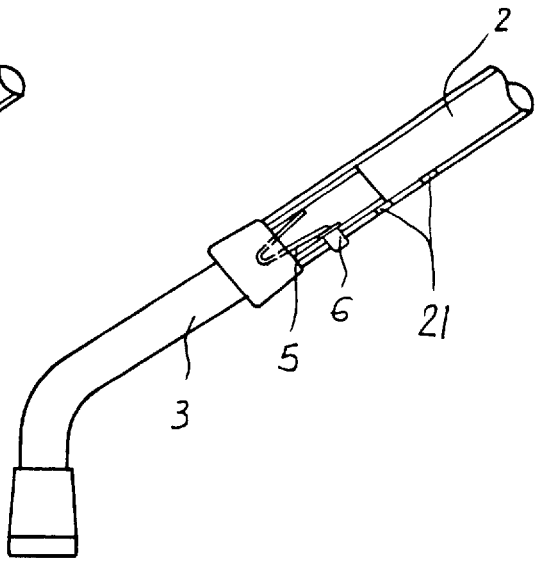
FIG. 5A sectional view of a part of the present invention, showing the connection between one leg and one end of the corresponding U-tube.
FIG. 5B is similar to FIG. 5A but showing the elevation of the leg adjusted.

Referring to FIGS. 2,3,4,5A and 5B, a folding collapsible chair in accordance with the present invention is generally comprised of a seat plate 1, and a folding stand C. The seat plate 1 has a concave top, a plurality of vertical through holes 12, two hand holes 13 transversely disposed near two opposite sides for the holding of the hand, a downward stop block 11 downwardly raised from one side in the middle, and two coupling grooves 14;15 bilaterally and longitudinally disposed at the bottom (see FIG. 4). The folding stand C is comprised of two U-tubes 2;2' pivoted together by rivets 4, and four tubular legs 3 respectively mounted in two opposite ends of each U-tube 2 or 2'. Each U-tube 2 or 2' has a longitudinal row of locating holes 21 or 21' at each of its two opposite ends. Each tubular leg 3 or 3' has a through hole 31 or 31' at one side near the top. A spring 5 or 5' is mounted inside each tubular leg 3 or 3', having one end fixedly mounted with a retainer rod 6 or 6', which is forced by the spring 5 or 5' out of the through hole 31 or 31' of the corresponding tubular leg 3 or 3' into one locating hole 21 or 21' of one end of the corresponding U-tube 2 or 2'.

Referring to FIGS. 3 and 4 again, the U-tubes 2;2' are respectively and peripherally forced into engagement with the coupling grooves 14;15 of the seat plate 1, and then a locating plate 7 of arched cross section is fixedly secured to the seat plate 1 over one U-tube 2;2' to secure the folding stand C to the seat plate 1. This arrangement permits the U-tube 2 to be forced into engagement with the corresponding coupling groove 15 or disconnected from it.

Figure 6:
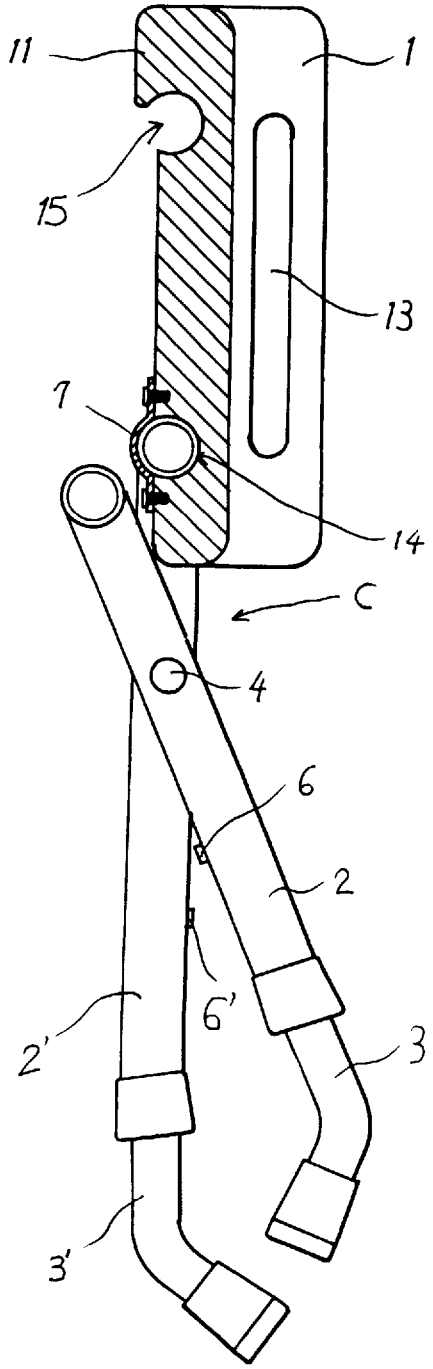
FIG. 6 shows the folding collapsible chair of the present invention collapsed.

Referring to FIG. 6 and FIG. 4 again, when the two U-tubes 2;2' are turned relative to each other to open the folding stand C, the U-tube 2 is forced into engagement with the corresponding coupling groove 15 and stopped in place by the downward stop block 11 of the seat plate 1, and therefore the folding chair is set in the operative condition as shown in FIG. 4; on the contrary, when the two U-tubes 2;2' are turned relative to each other reversely, the U-tube 2 is disengaged from the corresponding coupling groove 15, and the folding chair can then be set in a collapsed condition as shown in FIG. 6.

Referring to FIGS. 5A and 5B again, when the retainer rod 6 forced inwards, the leg 3 can then be moved in and out of the corresponding U-tube 2. By shifting the retainer rod 6 from one locating hole 21 to another, the elevation of the chair is adjusted.

While only one embodiment of the present invention has been shown and described, it will be understood that various modifications and changes could be made thereunto without departing from the spirit and scope of the invention disclosed.

What the invention claimed is:

1. A folding, collapsible chair comprising:

a) a seat plate having a concavely curved seating surface and a planar bottom surface with a plurality of coupling grooves, integrally formed thereon the seat plate further having a plurality of through holes;

b) a first generally U-shaped tube having a first base portion pivotally fastened to a first of the plurality of coupling grooves of the seat plate and a pair of first tubular leg portions;

c) a second generally U-shaped tube having a second base portion releasably retained in a second of the plurality of coupling grooves of the seat plate and a pair of second tubular leg portions, each of the second tubular leg portions pivotally connected to one of the first tubular leg portions, whereby removal of the second base portion from the second coupling groove enables the chair to be folded and collapsed; and d) a stop block integrally formed and extending down wardly from the bottom surface and forming an outer side of the second coupling groove and adapted for stopping the base portion of the second U-tube at the second coupling groove.

2. The folding collapsible chair according to claim 1, further comprising:

a) a plurality of locating holes in each leg portion of said first and second U-shaped tubes;

b) an adjustable leg member telescopically received in each leg portion, each adjustable leg member having a side through hole and a spring biased retainer rod protruding outwardly from said side through hole and located so as to engage one of the plurality of locating holes in the associated leg portion so as to adjustably locate the leg member relative to the associated leg portion.

3. The folding collapsible chair according to claim 1, wherein each adjustable leg member comprises a distal end portion extending at an oblique angle to a portion of the leg member telescopically received in tube leg portion of the generally shaped U-shaped tubes.

* * * * *